US005167401A

United States Patent [19]

James et al.

[11] Patent Number: 5,167,401

[45] Date of Patent: Dec. 1, 1992

[54] HOIST DRIVE AND METHOD FOR DRIVING A DOUBLE HOIST CARRYING APPARATUS

[75] Inventors: Michael D. James, Franklin; Robert H. Reuss, Milwaukee, both of Wis.

[73] Assignee: Harnischfeger Corporation, Brookfield, Wis.

[21] Appl. No.: 572,193

[22] Filed: Aug. 23, 1990

[51] Int. Cl.[5] ..... B66C 13/38; B66D 1/68

[52] U.S. Cl. ..... 254/292; 254/316; 318/53; 318/66

[58] Field of Search ..... 254/292, 316; 294/68.23; 212/215; 318/41, 50, 51, 53, 66, 68, 59

[56] References Cited

U.S. PATENT DOCUMENTS

| | | | |
|---|---|---|---|
| 872,523 | 12/1907 | Libby | 254/292 |
| 1,834,785 | 12/1931 | Jones | 318/51 |
| 1,958,037 | 5/1934 | Engler | 254/316 |
| 2,538,061 | 1/1951 | Torok | 254/292 |
| 3,531,088 | 9/1970 | Kraschnewski | 254/292 |

FOREIGN PATENT DOCUMENTS

| | | | |
|---|---|---|---|
| 1032910 | 6/1958 | Fed. Rep. of Germany | 254/292 |

*Primary Examiner*—Katherine Matecki
*Attorney, Agent, or Firm*—Richard C. Ruppin

[57] ABSTRACT

A hoist drive for a double hoist carrying member having a hold hoist drum, a hold rope connected to the hold hoist drum and from which the carrying member is suspended, and a hold motor for rotating the hold hoist drum to raise and lower the carrying member. The hoist drive further includes a close hoist drum, a close rope connected to the close hoist drum and from which the carrying member is suspended, and a close motor for rotating the close hoist drum to raise and lower the carrying member. During raising of the carrying member, the hold and close motors are each supplied with a.c. power at different preselected frequencies. The hold and close motors each operate along a first pair of intersecting frequency to torque curves during a raising operation in which the hold motor curve is steeper than the close motor curve. During a lowering operation the hold and close motors operate along a second pair of intersecting frequency to torque curves in which the hold motor curve is also steeper than the close motor curve. Due to the intersection and relative slopes of the first pair and the second pair of curves, the speed of the hold motor follows the speed of the close motor during both raising and lowering operation and the motors operate at the intersection points of the pairs of curves and share the load during both raising and lowering operation.

26 Claims, 4 Drawing Sheets

HOIST DRIVE AND METHOD FOR DRIVING A DOUBLE HOIST CARRYING APPARATUS

FIELD OF THE INVENTION

This invention relates to a hoist drive and method for driving each of the two hoists of a double hoist carrying apparatus which is opened and closed, and raised and lowered, by the operation of the two hoists. More specifically, the invention relates to the use of a.c. induction motors provided with adjustable frequency power supplies and having frequency to torque curves which enable sharing between the two hoists and control of opening and closing of the bucket.

BACKGROUND OF THE INVENTION

In lifting mechanisms and buckets having two scoops which are pivotally moveable to pick up a load, separate hoists are commonly used for lifting and lowering the bucket and for opening and closing the bucket scoops. The hoist used to lift and lower the bucket is generally referred to as the hold hoist and the hoist used to open and close the bucket scoops is generally known as the close hoist. Due to the use of the two hoists, such bucket apparatus are commonly known as double hoist buckets. Although the primary use of the bucket opening and closing hoist and the ropes which extend from it to the bucket is to operate the two bucket scoops, because two hoists are required for the bucket scoop operation and the lifting of the bucket, it is also desirable and common to use both hoists for lifting the bucket and material which it carries and to share the total load as equally as possible between the two hoists. Although the foregoing and ongoing are with reference to buckets having scoops for carrying material, they also apply to grapples having hooks for carrying material.

A common type of drive for both the close and hold hoists is an alternating current wound rotor induction motor for each hoist. The wound rotor motor for the close hoist can be operated separately to open and close the bucket and the wound rotor motor for the hold hoist can be used separately to raise or lower the bucket. The two motors can be used together to raise or lower the bucket and can also be used in conjunction with each other to provide bucket opening and closing manipulation while also raising or lowering the bucket. The use of wound rotor motors having external resistors which can be switched into and out of each motor rotor circuit and a braking system using, e.g., eddy current brakes, provides speed matching and flexibility from speed to torque curves which have their slope varied by the insertion or removal of the resistance and use of the brakes.

However, wound rotor motor drives have well-known drawbacks which include the high cost of such motors, brakes and the external resistors, high maintenance, poor efficiency, and problems relating to dissipation of the heat generated by the external resistors. In the instant invention, squirrel cage a.c. induction motors or relatively inexpensive wound rotor motors are used and the problems of the typical wound rotor motor drives previously used are eliminated.

SUMMARY OF THE INVENTION

It is a general object of the invention to provide a method for driving a double hoist carrying apparatus which is relatively low in cost, has minimal maintenance and a high level of efficiency, and enables close control and flexible load sharing operation.

The invention is accomplished by providing a hoist drive for a double hoist carrying member in which the carrying member has a frame and a plurality of openable and closeable members attached to the frame. The hoist includes a hold hoist having a hold hoist drum, hold rope means connected to the hold hoist drum and from which the carrying member is suspended, and a rotatable hold motor for rotating the drum to raise and lower the carrying member. The hoist further includes a close hoist having a close hoist drum, close rope means connected to the close hoist drum and from which the carrying member is suspended, and a rotatable close motor for rotating the drum to raise and lower the bucket. During raising of the bucket, the hold motor is supplied with a.c. power at a preselected first hold motor frequency and the close motor is supplied with a.c. power at a preselected first close motor frequency. The carrying member may comprise a bucket in which the plurality of openable and closeable members are a pair of bucket scoops.

During a raising operation, the hold motor means operates along a frequency to torque first hold curve which determines the speed of the hold motor means. The first hold curve has a first hold slope and a first hold frequency range determined by the preselected first hold motor frequency. Also, during a raising operation, the close motor means operates along a frequency to torque first close curve which determines the speed of the close motor means. The first close curve has a first close slope not greater than the first hold slope of the first hold curve and a first close frequency range determined by the preselected first close motor frequency. The first hold curve has a first hold portion located along the first hold frequency range and the first close curve has a first close portion located along the first close frequency range at frequencies higher than the first hold portion at corresponding torque values. Consequently, the close motor means rotates at a higher speed than that of the hold motor means when the close motor means operates along the first close portion of the first close curve.

During a lowering operation, a.c. power is supplied to the hold motor at a preselected second hold motor frequency and to the close motor at a preselected second close motor frequency. The hold motor means operates along a frequency to torque second hold curve which determines the speed of the hold motor means during lowering of the bucket. The second hold curve has a second hold slope and a second hold frequency range determined by the preselected second hold motor frequency. The close motor means operates along a frequency to torque second close curve which determines the speed of the close motor means during lowering of the bucket. The second close curve has a second close slope not greater than the second hold slope of the second hold curve and a second close frequency range determined by the preselected second close motor frequency. The second hold curve has a second hold portion located along the second hold frequency range and the second close curve has a second close portion located along the second close frequency at frequencies lower than the second hold portion at corresponding torque values. Thus, the close motor means rotates at a lower speed than that of the hold motor means when the close motor means operates along said second close portion of the second close curve.

During a raising operation, when the close motor rotates at a slightly higher speed than the speed of the hold motor so that the close hoist drum correspondingly rotates at a slightly higher speed than the rotational speed of the hold hoist drum, the close hoist drum applies tension to the close rope means to close the openable and closeable members of the carrying member. During a lowering operation, when the close motor rotates at a slightly slower speed than the speed of the hold motor so that the close hoist drum correspondingly rotates slightly slower than the lowering rotational speed of the hold hoist drum, the close hoist drum applies tension to the close rope means to also close the openable and closeable members.

In the operation of the hoist, the close motor is operated along a first close frequency (or speed) to torque curve having speed values decreasing with increasing torque output to rotate the close hoist drum and raise the load. The hold motor is operated along a first hold frequency (or speed) to torque curve having speed values decreasing with increasing torque output a greater amount than the speed values of the close speed to torque curve to rotate the hold hoist drum and also raise the load. When the load is applied to the close motor and the hold motor during a raising operation, the close motor increases its torque output to assume a portion of the load and consequently decreases in speed as it operates along the first close speed to torque curve. The hold motor also increases its torque output to assume a portion of the load and consequently decreases in speed a greater amount than the speed decrease of the close motor as the hold motor operates along the first hold speed to torque curve. In response to the greater speed decrease of the hold motor than the speed decrease of the close motor so that the close motor speed is higher than the speed of the hold motor, the portion of the load assumed by the close motor increases. In response to the increase in the portion of the load assumed by the close motor, the speed of the hold motor increases to approach the speed of the close motor so that the load assumed by the hold motor also increases and the load assumed by the close motor decreases. Consequently, an equilibrium condition is quickly reached at which the load is shared by the close motor and hold motor at their approaching raising operating speeds.

During a lowering operation, the close motor is operated along a second close frequency (or speed) to torque curve having speed values increasing with increasing torque output to rotate the close hoist drum to lower the load. The hold motor is operated along a second hold frequency (or speed) to torque curve having speed values increasing with increasing torque output a greater amount than the speed values of the close speed to torque curve to rotate the hold hoist drum to also lower the load. When the load is applied to the close motor and hold motor, the close motor increases its torque output to assume a portion of the load and consequently increases in speed as it operates along the second close speed to torque curve. The hold motor also increases its torque output to assume a portion of the load and consequently increases in speed a greater amount than the speed increase of the close motor as the hold motor operates along the second hold speed to torque curve. In response to the greater speed increase of the hold motor than the speed increase of the close motor so that the close motor speed is slower than the speed of the hold motor, the portion of the load assumed by the close motor increases. In response to the increase in the portion of the load assumed by the close motor, the speed of the hold motor decreases to approach to speed of the close motor so that the load assumed by the hold motor increases and the load assumed by the close motor decreases. Consequently, an equilibrium condition is quickly reached at which the close motor and hold motor at their approaching lowering operating speeds.

BRIEF DESCRIPTION OF THE DRAWINGS

Further objects and advantages of the invention will appear when taken in conjunction with the accompanying drawings, in which.

DETAILED DESCRIPTION OF THE INVENTION

Figures 1, 3B:
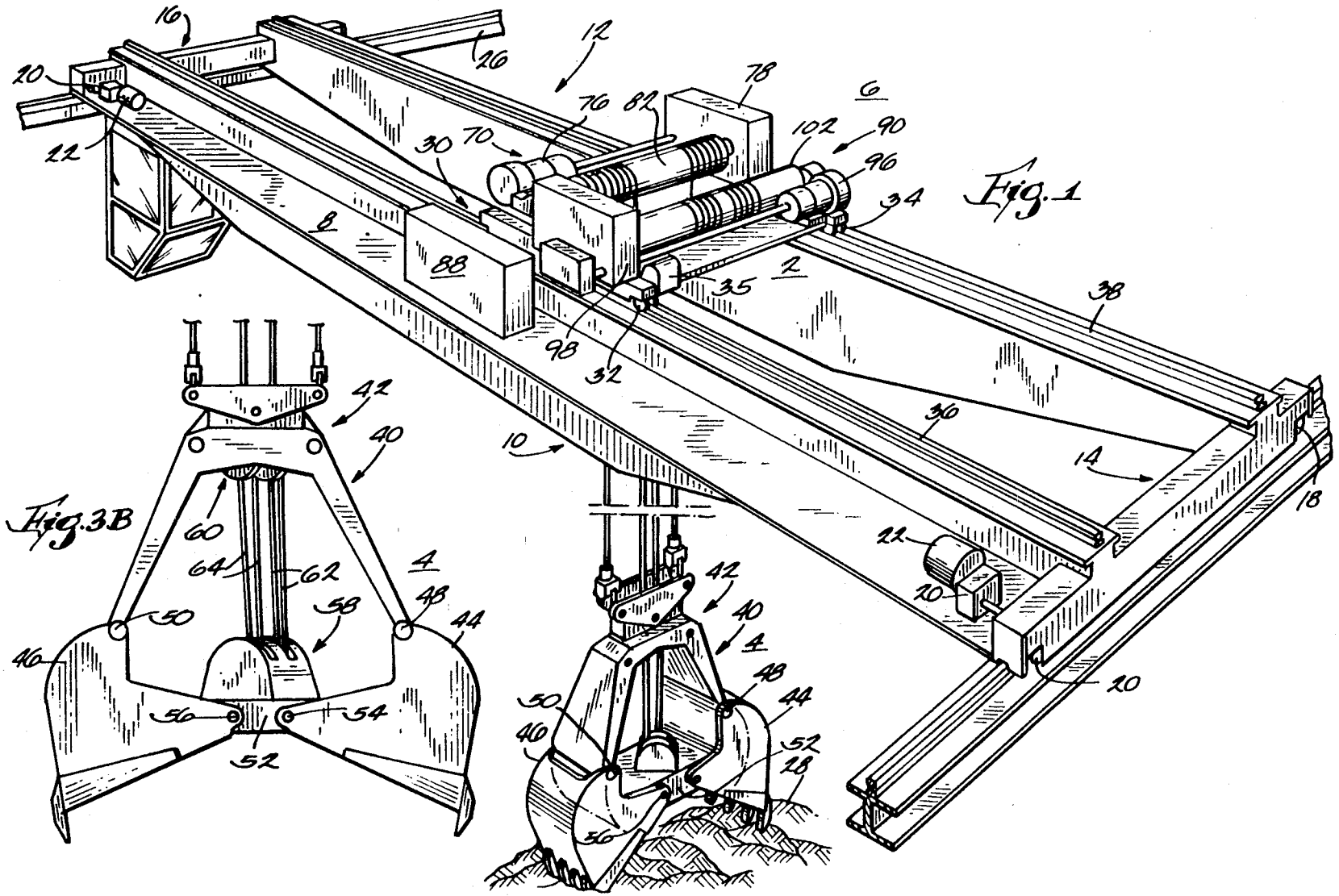
FIG. 1 is a perspective view of an overhead crane on which a double hoist carrying member bucket and the hoist drive according to the invention is supported.

Referring generally to FIGS. 1, 2, 3A and 3B, a hoist drive 2 from which a double hoist carrying member 4 is suspended is shown mounted on a trolley 6 which is supported and travelable on an overhead traveling bridge crane 8. The crane includes a pair of bridge cross members 10 and 12 affixed at their opposite ends to a pair of trucks 14 and 16. Idler wheels 18 and drive wheels 20 driven by motors 22 are mounted on the trucks 14 and 16 for moving the crane 8 along the parallel rails 24 and 26. The rails 24 and 26 are located such that the crane, as it moves along the rails, moves above material 28 which is to be picked up and moved by the carrying member 4.

The trolley 6 includes a frame 30 on which the hoist drive 2 is supported and a plurality of wheels such as wheels 32 and 34 rotatably mounted on the frame 2 and driven by a motor 35. Driving of the wheels 32 and 34 moves the trolley along trolley rails 36 and 38 such that the hoist drive 2 and carrying member 4 can be positioned on the bridge cross members 10 and 12 over the material 28.

Figure 3A:
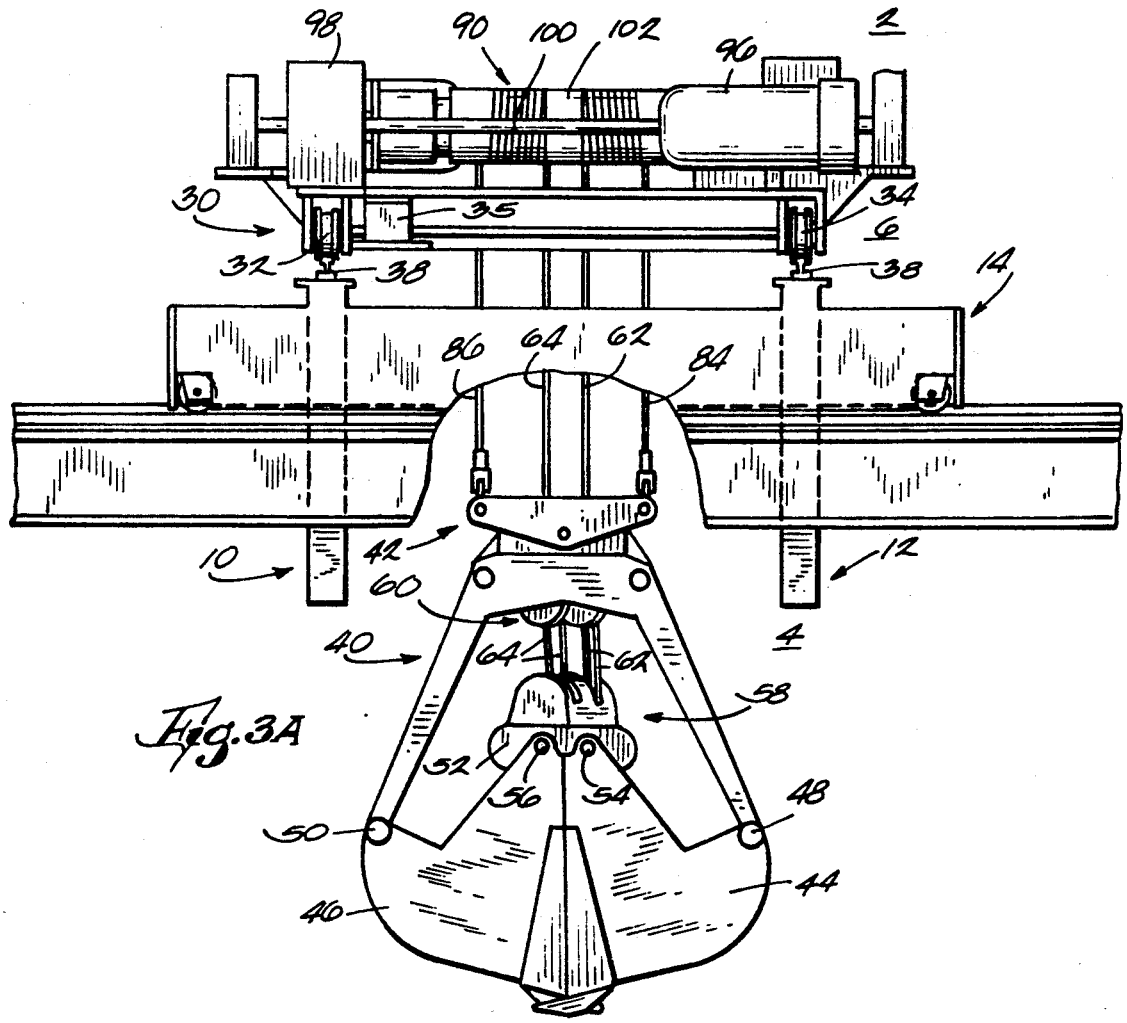
FIG. 3 is a side elevation view illustrating the double hoist bucket and hoist drive shown in FIGS. 1 and 2 with the carrying member shown in full lines in a closed position and in phantom lines in an open position.

The carrying member 4 illustrated is of a well-known bucket type, although grapple types are also well-known and operate in substantially the same manner. With reference to FIGS. 3, 3A and 3B, the bucket 4 includes an upper frame 40, an equalizer bar 42 pivotally attached to the upper end of the frame 40, and plurality of bucket members or scoops 44 and 46 respectively pivotally mounted at pivot points 48 and 50 on lower ends of the frame 40. The bucket 4 further includes a lower frame 52 pivotally connected at pivot points 54 and 56 to the bucket scoops 44 and 46, a lower sheave assembly 58 mounted on the lower frame 52, and an upper sheave assembly 60 mounted on the upper end of the upper frame 40. In FIG. 3A, the bucket 4 is shown in a closed position in which the bucket scoops 44 and 46 are in a relatively upward and engaged position and the lower sheave assembly 58 is in an upward position and is held from moving downward by the close ropes 62 and 64 due to its own weight, the weight of the lower frame 52 and the weight of the bucket scoops 44 and 46. In FIG. 3B, the bucket 4 is shown in an open position in which the bucket scoops 44 and 46 are relatively downward and disengaged and spaced from each other, and the lower sheave assembly 58 and lower frame 52 are positioned downwardly. The bucket tends to open, the bucket scoops 44 and 46 disengage from each other, and the lower sheave assembly 58 moves downwardly, in response to slack in the close ropes 62 and 64. If sufficient lengths of the close ropes 62 and 64 are paid out to permit the lower sheave assembly to move from its full upward position as shown in FIG. 3A to its full downward position as shown in FIG. 3B, which, for example, may be 20 to 40 feet of rope for each of the close ropes 62 and 64, the bucket 4 will move due to the force of gravity on the lower sheave assembly 58, the lower frame 52, and the bucket scoops 44 and 46 to its full open position as shown in FIG. 3B.

Figure 2:
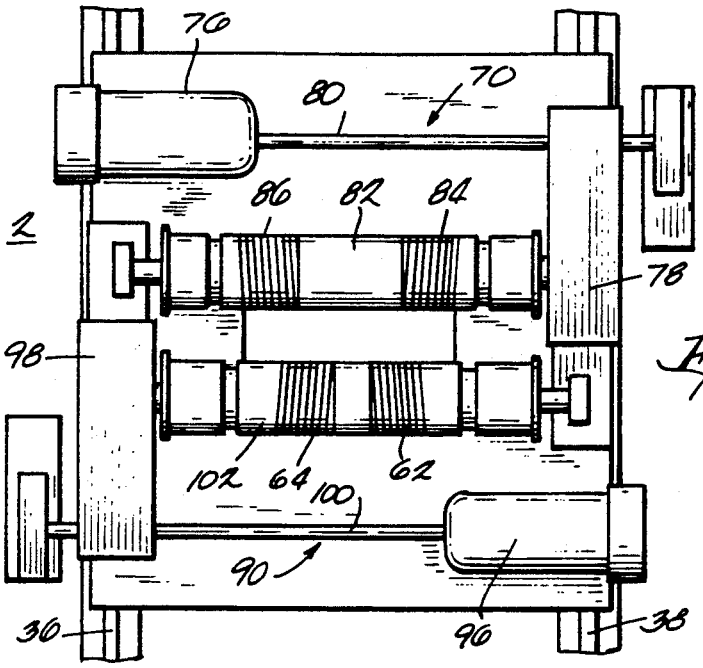
FIG. 2 is a plan view of the hoist drive illustrated in FIG. 1.

The hoist drive 2 includes a hold hoist 70 and a close hoist 90, as can be best seen in FIG. 2. The hold hoist 70 includes an a.c. induction drive motor 76, a gear box 78 connected to the motor 76 by a drive shaft 80, a rotatable hold hoist drum 82 driven by the motor 76 through the shaft 80 and the gear box 78, and hold hoist ropes 84 and 86. The ropes 84 and 86 are affixed to the drum 82 and to the equalizer bar 42, and are paid out from and wound onto the drum 82 when it is rotated in either one of two opposite directions by the motor 76. Rotating the motor 76 and drum 82 to wind the ropes 84 and 86 onto the drum raises the bucket 4 and rotation of the motor 76 and drum 82 to pay ropes 84 and 86 out from the drum lowers the bucket 4. The hold hoist 70 also includes a hold hoist control 72 and a hold hoist adjustable frequency power supply 150 for providing power to motor 76, which are shown schematically in FIG. 5 and are contained within the enclosure 88 mounted on the bridge cross member 10.

The close hoist 90 includes an a.c. induction drive motor 96, a gear box 98, a drive shaft 100 connecting the motor 96 to the gear box 98, and a close hoist drum 102 rotatably driven by the motor 96 through the shaft 100 and gear box 98. The close ropes 62 and 64, connected to the upper and lower sheave assemblies 60 and 58 of the bucket 4, are wound onto the drum 102 when it is rotated in a first direction by the motor 96 to move the lower sheave assembly 58 upward to its upward position as shown in FIG. 3A against its own weight and the weight of the lower frame 52 and bucket scoops 44 and 46 to thereby close the bucket 4. Rotating the drum 102 in a second, opposite direction by the motor 96 pays the close ropes 62 and 64 out from the drum 102 to lower the lower sheave assembly 58 and thereby open the bucket 4. In addition to closing the bucket 4 when the close ropes 62 and 64 are wound onto the drum 102, when the lower sheave assembly 58 has reached its upward position and the bucket is fully closed, the continued winding of the ropes 62 and 64 onto the drum 102 will raise the bucket 4. If the hold ropes 84 and 86 are also being wound onto the hold drum 82 at essentially the same rotational speed as that of the close ropes 62 and 64, the hold ropes and close ropes will share the load of the bucket and any material 28 that it might be carrying. Similarly, if the close ropes 62 and 64 are holding the lower sheave 58 in its upward position or have released the sheave assembly 58 so that it has moved downward to its downward position, and the close ropes 64 and 62 continue to be paid out from the drum 102 at the same rate as the paying out of the hold ropes 84 and 86 from the drum 82, the hold ropes and close ropes will share the load of the bucket 4 and any material 28 that it may be carrying as the bucket is lowered. The close hoist 90 also includes a close hoist control 92 and a close hoist adjustable frequency power supply 180 for providing power to motor 96, both contained within the enclosure 88 mounted on the bridge cross member 10.

Figure 5:
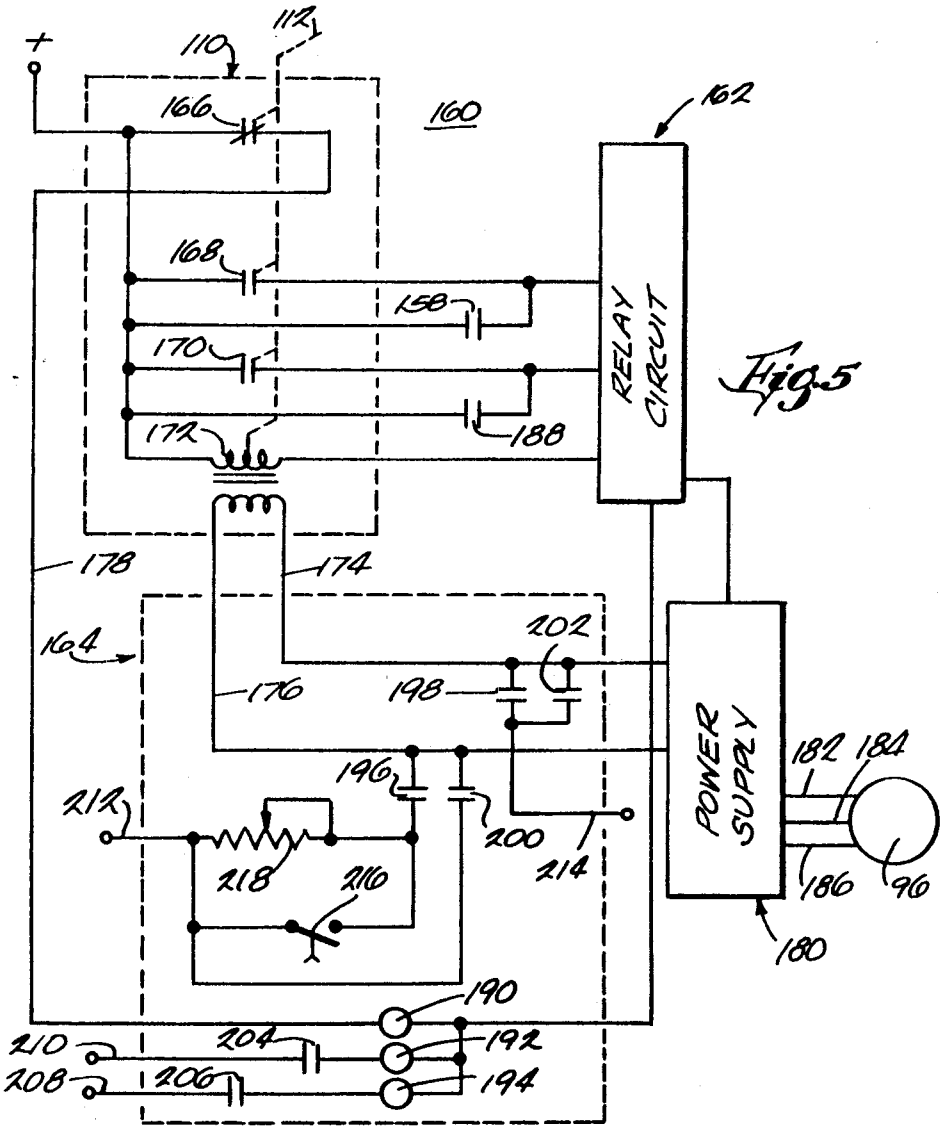
FIG. 5 is a schematic circuit diagram for the close hoist drive section of the hoist drive according to the invention.
Figure 4:
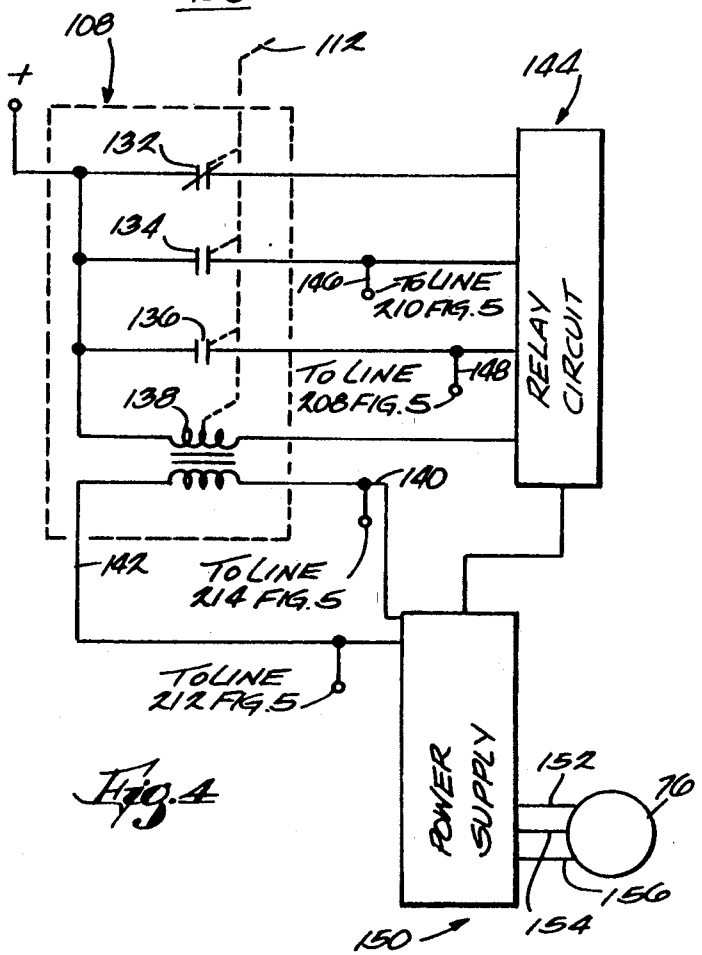
FIG. 4 is a schematic circuit diagram for the hold hoist drive section of the hoist drive according to the invention.
Figure 6:
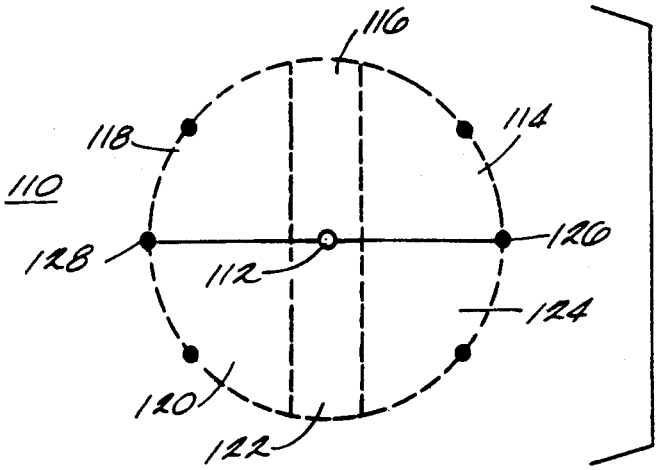
FIG. 6 is a schematic representation of a control stick used in the operation of the circuits illustrated in FIGS. 4 and 5.

With reference to FIGS. 4–6, the raising and lowering and opening and closing of the bucket 4 is accomplished by use of power supplies 150 and 180 and by use of hold controller 130 and close controller 160, respectively shown in FIGS. 4 and 5. The hold controller 130 includes a master switch circuit 108 and a hold relay circuit 144. The close controller 160 includes a master switch circuit 110, a close relay circuit 162, and a raise and lower circuit 164. The master switch circuits 108 and 110 are both controlled by a control stick 112, shown schematically in FIG. 6 and also shown in both FIGS. 4 and 5. It should be noted that the electrical lines referred to herein between major circuit components, such as relay circuit 144 and power supply 150, represent one or more wire connections necessary for the operation of these circuits. Also, electrical power source connections which are well-known in the art are generally not shown. The control stick 112 is movable by operating personnel from its vertical position as shown in FIG. 6 into any one of the operating indication sectors 114–124 and in a circular direction from any one of the sectors 114, 116, 118, 120, 122, 124 into the adjacent sector or to sector locations 126 and 128. Referring to FIG. 4, the master switch 108 includes an off position safety contact 132, a raise contact 134, a lower contact 136, and a variable inductor 138 which produces a variable voltage output on lines 140 and 142 as an input motor speed reference for use in controlling the output frequency of the power supply 150. The relay circuit 144, in response to the closing or opening of contacts 132, 134 and 136, provides to the power supply 150 the appropriate control signals to prevent the power supply 150 from producing output power on lines 152, 154 and 156 or to produce output power enabling the motor 76 to rotate the hold hoist drum 82 in a bucket raising direction or produce power enabling the motor 76 to rotate the drum 82 in a bucket lowering direction.

The close controller 160 and close adjustable frequency power supply 180 are illustrated in FIG. 5. The master switch 110 that is part of the close controller 160 includes an off position safety contact 166, a raise contact 168, a lower contact 170, and a variable inductor 172 for producing a variable voltage on lines 174 and 176 as an input motor speed reference signal for use in controlling the output frequency of the power supply 180. The relay circuit 162 contains suitable relays and contacts for receiving signals as a result of the closing or opening of contacts 166, 168 and 170. In response to these signals, the relay circuit 162 provides to the power supply 180 appropriate control signals to prevent the power supply 180 from producing output power on lines 182, 184 and 186 or to produce output power in a phase sequence on lines 182, 184 and 186 enabling the motor 96 to rotate the close hoist drum 102 in directions to either pay rope out from or take in and wind rope onto the drum. The raise and lower circuit 164 includes a raise relay 192 receiving an energizing signal through contact 134 of the master switch 108 when the contact 134 is closed, a lower relay 194 receiving an energizing signal through the raise contact 136 of hold controller 130 when the contact 136 is closed, and contacts 196, 198, 200 and 202. The contact 196 is connected through a timer contact 216 in parallel with a variable resistance 218 to line 142 and thereby to an output voltage signal from the variable inductor 138 of the master switch 108 of the hold controller 130. The contact 200 is also connected to the line 142 from the inductor 138. The contacts 198 and 202 are both connected through lines 214 and 140 to the hold control variable inductor 138.

Figure 7:
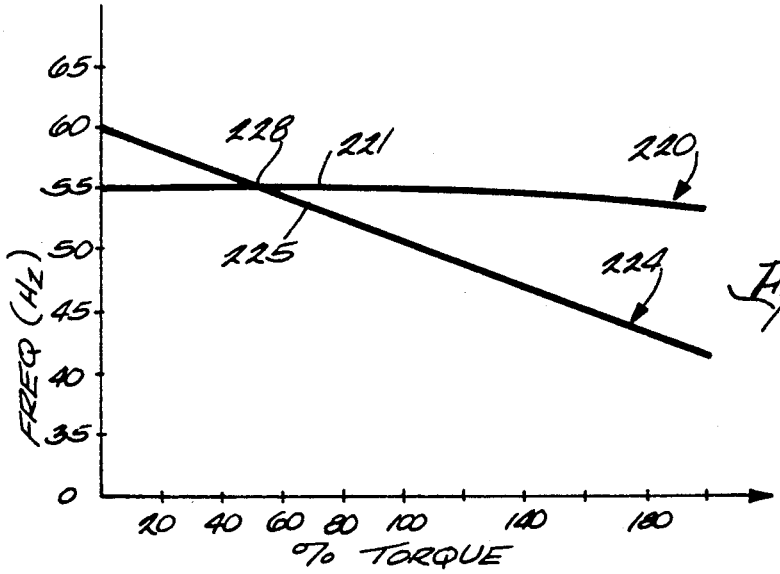
FIG. 7 is a graph illustrating frequency versus torque operating characteristic curves for the hold hoist motor and close hoist motor of the hoist drive according to the invention during a carrying member raising operation.
Figure 8:
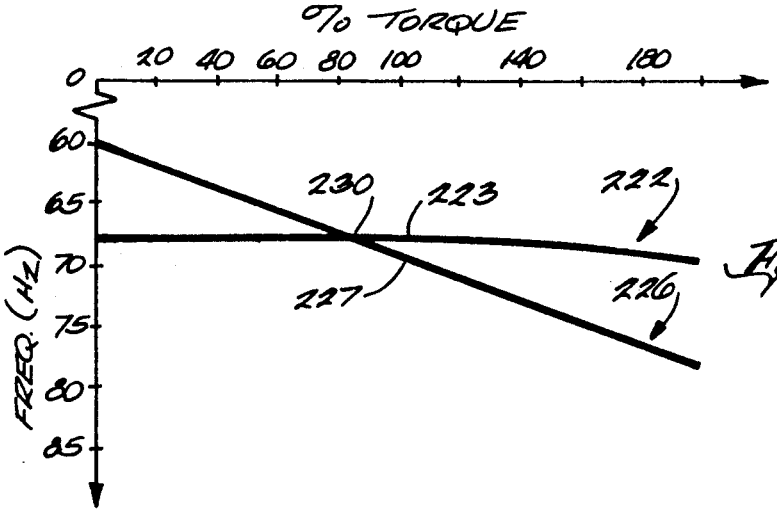
FIG. 8 is a graph illustrating frequency versus torque operating characteristic curves for the hold hoist motor and close hoist motor of the hoist drive according to the invention during a carrying member lowering operation.

The close drive motor 96 is an a.c. induction motor of either a squirrel cage or wound rotor type, having a frequency to torque operating characteristic curve 220 when the motor 96 is operating the hoist drum 102 to take rope up as shown in FIG. 7. The curve 220 has a relatively flat or level slope and, for example, provides a slip at 100% rated torque of 3% or approximately 2 hertz when the motor is provided with a 60 hertz three phase power supply. The frequency to torque operating characteristic curve 222 of the close motor 96 is shown in FIG. 8 when the motor is rotating to cause rope to be paid out from the drum 102 and has substantially the same slope as the curve 220 shown in FIG. 7. The hold drive motor 76 is an a.c. induction motor of either a squirrel cage or wound rotor type, having a frequency to torque operating characteristic curve 224 as shown in FIG. 7 and 226 as shown in FIG. 8. The curves 224 and 226 have relatively high slopes such that the slip of the motor at 100% rated torque when supplied by three, phase power from a 60 hertz source is, for example, 20% or approximately 12 hertz. The suitable range of values of the slope of the curves 224 and 226 result in motor slip of approximately 5 to 30%. The slope of the curves 224 and 226 may be essentially the same for both the raise rotating operation of the hold motor and the lowering rotation operation of the hold motor. The motors 76 and 96 are each supplied with variable frequency three phase power from the power supplies 150 and 180 at any frequency between zero hertz and a predetermined maximum frequency in excess of the rated 60 hertz operation of the motors. For example, the close motor 96 is shown in FIG. 8 as being supplied at a frequency of approximately 68 hertz during lowering operation such that the bucket 4 may be lowered at a faster rate during the lowering operation than would be possible if the supply frequency to the close motor were limited to 60 hertz. Although the curves shown in FIGS. 7 and 8 are characterized as frequency to torque curves, they may also be considered as speed to torque curves where speed is calculated from the frequency supplied and the number of poles of the motor.

With respect to the operation of the hoist drive 2 and the bucket 4, when the bucket is initially closed and is located at the top of a lift cycle, it will appear as shown in FIG. 3A. Prior to beginning operation, control stick 112 is in a vertical position, the contacts 132 and 166 are closed, the contacts 134, 136, 168 and 170 are open, and neither of the power supplies 150 and 180 is producing alternating current power to the motors 76 and 96. To pick up a load of material 28, the bucket is first opened. The control stick 112 is moved to the control location 128 which causes the safety contact 166 to open, the lower contact 170 to close, and the variable inductor 172 to be positioned to provide a speed reference signal voltage to the power supply 180 to produce the maximum lowering frequency of 68 hertz to the motor 96. Simultaneously, the control stick 112 at position 128 causes the master switch 108 to maintain contact 132 closed and the raise and lower contacts 134 and 136 open so that a raise or lower signal is not applied to the power supply 150 and thereby the hold hoist motor 76 is not operated and the hold hoist drum 82 remains stationary. As a result, the bucket 4 as a whole remains stationary, but the close ropes 62, 64 are paid out and slacked so that the weights of the lower sheave assembly 58 and the bucket scoops 44 and 46 cause their movement to a downward position and the opening of the bucket. The bucket 4 is now in the position substantially as shown in FIG. 3B.

After the bucket 4 is open, the control stick 112 may be moved to the lower sector 122 in which the bucket 4 will be lowered essentially to a position in contact with the material 28, as shown in FIG. 1. With the control stick 112 in lower sector 122, the hold control 130 provides control signals to direct lowering of the hold hoist drum 82 but the close controller 160 does not provide control signals to direct operation of the close hoist motor 96 because the master switch 110 operator cam maintains the safety contact 166 closed and the raise and lower contacts 168 and 170 open. However, with the safety contact 166 closed, the relay 190 is energized through line 178 so that its contacts 204 and 206 are closed to thereby provide a circuit through which either raise relay 192 or lower relay 194 may be energized. Further, with the control stick 112 in the lower sector 122, in the master switch circuit 108, the lower contact 136 will be closed so that a signal is conducted on line 146 to line 210 in FIG. 5 and through closed contact 204 to relay coil 192 to energize the latter. Upon energization of relay coil 192, contacts 196 and 198 are closed to conduct the speed reference signal voltage from inductor 138 in the hold control 130 to the close motor power supply 180 through lines 140 and 214, and 142 and 212. Since the same speed reference signal voltage is also conducted to power supply 150 on lines 140 and 142, the hold controller 130 controls the output power of both power supplies 150 and 180. In addition, energizing coil 192 causes closure of contact which causes a lower or rope pay out signal to the relay circuit 162 and, in turn, a signal from the circuit 162 to the power supply 180 to rotate the motor 96 and thereby the close hoist drum 102 in a rope lowering direction. Thus, in response to the speed reference signal to the power supply 150 and the speed reference signal to the power supply 180, the power supply 150 and power supply 180 respectively produce to the hold hoist motor 76 and close hoist motor 96, a.c. power at 60 hertz and a.c. power at 68. Due to the lowering signal to both of the power supplies 150 and 180, the phase sequence on the lines 152, 154 and 156 and 182, 184 and 186 will be in a direction such that both the close and hold hoists operate in a lowering direction.

When the bucket 4 has been lowered to the position shown in FIG. 1, the control stick 112 may be moved to the close location 126. When the stick 112 is at the location 126, the safety contact 132 of the master switch 108 is closed, the raise and lower contacts 134 and 136 are open, and the inductor 138 speed reference voltage signal output is zero. Thereby, power is not supplied to the motor 76 and the motor does not rotate the drum 82. However, in the close controller 160, the safety contact 166 of the master switch 110 is open, the raise contact 168 is closed, the lower contact 170 is open, and the inductor 172 generates a speed reference voltage calling for 55 hertz power out to close motor 96 from the power supply 180. The closing of the raise contact 168 also causes the relay circuit 162 to provide a signal to the power supply 180 directing the latter to provide the power to the motor 96 in a hoist raising rotational direction. The raising rotational direction of the close hoist drum 102 winds close ropes 62 and 64 onto the drum to thereby raise and tension the ropes and raise the lower sheave assembly 58 to move the bucket scoops 44 and 46 toward a closed position. As a result of the scoops 44 and 46 moving toward a closed position when the bucket is in contact with material 28, material 28 is scooped into the bucket as the bucket moves to the closed position as shown in phantom lines in FIG. 1.

The control stick 112 may now be moved to the raise sector 116 in which, in close controller 160, the safety contact 166 of the master switch 110 is closed, the raise and lower contacts 168 and 170 are open and no speed reference voltage signal is generated by the inductor 172. However, the relay 190 is energized through closed contact 166 and the contacts 204, 206 and 158 are thereby closed. Since contact 158 is closed, the close relay circuit 162 sends a raise signal to the close power supply 180. With the control stick 112 in sector 116, the master switch 108 in hold control 130 has its safety contact 132 open, its lower contact 134 open, its raise contact 134 closed and the inductor 138 generates a speed reference voltage signal. The hold relay circuit 144 consequently sends a raise signal to the hold power supply 150 and the raise relay 192 is energized through contact 204. As a result of energization of relay 192, the contacts 196 and 198 in the circuit 164 will close and a speed reference voltage signal from the variable inductor 138 of the master switch 108 in the hold controller 130 will be received through lines 140, 214 and 142, 212 by the close power supply 180. In response to the signal from the relay circuit 144 and the speed reference voltage signal from the induction 138, the hold power supply 150 produces a.c. power at a frequency of 60 hertz to the hold motor 76 to rotate the motor and the drum 82 in a raising direction. In response to the signal from the relay circuit 162 in the close control 162 and the speed reference signal from the inductor 138 in the hold controller 130, the close power supply 180 produces a.c. power of 55 hertz to the close motor 96 to rotate the close motor and the close drum 102 in a raising direction. The bucket 4 is thereby raised to a position similar to that shown in FIG. 3A, however, the bucket is loaded with material 28. The trolley 6 from which the loaded bucket 4 is suspended may now be moved along the bridge cross members 10 and 12 and the entire crane may be moved along the rails 24 and 26 to a position between the rails at which it is desired to dump the loaded bucket 4. When the desired position is reached, the control stick 112 may be moved to the lower sector 122 to again cause the bucket 4 to lower as previously described. At the height at which it is desired to open the bucket to unload it, the control stick 112 may be moved to the open location 128 where the bucket is opened in the same manner as previously described and the load material 28 is dumped.

The other sectors are 114, 118, 120 and 124 of the master switch controls 108 and 110 may also use in raising and lowering the hoist and opening and closing the bucket and provide additional flexibility in these operations. In the sector 114, movement of the control stick 112 generally in a circular direction toward location 126 causes the raise contacts 134 and 168 in the master switch 108 of the hold control 130 and the master switch 110 in the close controller 160 to be closed so that the hold and close hoist motors and drums rotate in a raising direction, the close power supply 180 supplies power at a frequency of 55 hertz and the hold power supply 150 supplies power at a frequency decreasing from 60 hertz toward zero hertz. Consequently, tension on the close ropes 62 and 64 increases relative to the tension on the hold ropes 84 and 86 so that the bucket has a closing tendency. Operation in this area of the sector 114 may be used to control the extent of closing, digging action of the bucket scoops 44 and 46. When the control stick 112 is moved in the sector 114 in the direction of sector 116, the raise contacts 134 and 168 are closed so that the hold and close hoists and drums operate in a raising direction, the frequency of the hold power supply 150 is maintained at 60 hertz and the frequency of the close power supply 180 is decreased from 55 hertz toward zero hertz. This mode of operation raises the bucket while providing it with an opening tendency and may be used to permit material 28 in the bucket to sift out gradually while the bucket is being moved by the trolley or crane to spread the material 28 over the area below the crane.

With the control stick 112 in the control sector 124, movement of the stick 112 generally in the direction of the location 126 causes the lower contacts 136 and 170 of the hold and close controllers 130 and 160 to close. This results in the power supplies 150 and 180 providing power in a frequency sequence which rotates the hold and close control motors and drums in a lowering direction in which the frequency of the close power supply decreases from a maximum value of 68 hertz toward zero hertz and the frequency of the hold power supply is maintained at 60 hertz to cause the bucket 4 to tend to close. When the control stick 112 is moved in sector 124 toward the lower sector 122, the frequency of the power provided by the hold power supply 150 is decreased while the frequency of the power provided by the close power supply 180 is maintained to cause the close ropes 62 and 64 to slack and the bucket 4 to have a tendency to open. This control position can also be used to permit material 28 to flow gradually out of the bucket to spread it during movement of the crane.

With the control stick 112 in sector 120, when the control stick 112 is moved toward sector 122, the close and hold frequencies from the respective close power supply 180 and hold power supply 150 rotate the close motor and drum and the hold motor and drum in their lowering directions. The frequency of the power provided to the hold motor by the hold power supply 150 is maintained at a frequency of 60 hertz while the frequency of the power supplied by the close power supply 180 to the close motor and drum is decreased such that tension is maintained on the close ropes 62 and 64 to give the bucket a tendency to close. When the joy stick 112 is moved in sector 120 toward the open location 128, the close motor and hoist and hold motor and hoist are operated in a lowering direction with the frequency of the power provided by the close power supply 180 being maintained at 68 hertz and the frequency of the power provided by the hold power supply 150 being decreased from 60 hertz toward zero hertz to give the bucket 4 a tendency to open. When the control stick 112 is moved in the sector 118 toward the open location 128, the hold motor and drum and close motor and drum are rotated in a raising direction. The frequency of the power provided by the close power supply 180 to the close motor is maintained at 55 hertz and the frequency of the power provided by the hold power supply to the hold motor is decreased from a maximum of 60 hertz toward zero to cause the close motor and drum to maintain tension on the close rope 62 and 64 so that they tend to cause the bucket 4 to close. When the stick 112 is moved in sector 118 toward the raise sector 116, the close motor and hold motor are rotated in a raising direction. The frequency of the power provided by the close power supply 180 is decreased from a maximum value of 55 hertz and the frequency of the power provided by the hold power supply 150 is maintained to cause the bucket 4 to have a tendency to open.

The frequency of the power provided to hold hoist motor 76 and close hoist motor 96 respectively from the adjustable frequency power supplies 150 and 180 may be varied over a range of zero to as high as 200 hertz. However, as power supply frequencies go above the rated frequency of the motors at their rated torque, the level of the torque that may be supplied by the motors decreases. The adjustable frequency power supplies 150 and 180 may be adjusted to provide only up to the maximum frequency power which may be accepted by the respective motors 76 and 96 without their reaching their breakdown torque levels when a load equal to the motor's rated load at 60 hertz is applied. In FIG. 7, the hold power supply 150 is adjusted to provide power at a frequency to the motor 76 of from zero hertz to 60 hertz during a raising operation and the close adjustable frequency power supply 180 is adjusted to provide power at a frequency of zero to 55 hertz to the close motor 96 during a raising operation. With reference to FIG. 8, the hold adjustable frequency power supply 150 is adjusted to provide power at a frequency of zero to 60 hertz to the hold motor 76 and the close adjustable frequency power supply 180 is adjusted to provide power at a frequency of zero to 68 hertz to the close motor 96.

During a raising operation of the bucket 4, with the control stick 112 in raise sector 116 for example, power will be supplied to the hold motor 96 and close motor 92 respectively at 60 hertz and 55 hertz. Thus when the control stick 112 is moved to the sector 116 and power is initially supplied to the hold motor 76 and close motor 96, the hold motor 76 and hold drum 82 begin rotating at a speed corresponding to 60 hertz and the close motor 96 and close hoist drum 102 begin operating at a rotation speed corresponding to 55 hertz. However, in a raising direction, due to the load of the bucket and any material 28 that it might be carrying, the close motor 96 produces a torque output and slows down to a speed determined by the slope of its characteristic operating curve 220. The hold motor 76 also slows down as it provides torque output to rotate the motor 76 and raise the bucket 4 and load. However, due to the high slope of its characteristic operating curve 224, the motor 76 slows down as it picks up load to a much slower speed and will normally slow to a slower speed than that of the close motor as determined by the close motor characteristic operating curve 220. As the hold motor speed follows the operating curve 224 to a portion 225 of the curve 224 past the intersection 228 of the curves 224 and 220 such that the hold motor 76 slows to a slower speed than the close motor 96 as the close motor follows its operating curve 220 to a portion 221 of the curve 220 past the intersection 228, the torque output of and the load assumed by the close motor 96 increases because of its higher speed relative to the speed of the hold motor since the close motor is operating at a higher frequency area than the hold motor at a corresponding torque range value. In response, the hold motor 76 increases in speed toward the intersection 228 of its operating curve 224 with the operating curve 220 of the close motor 96 and assumes an increased portion of the load. In this manner, the hold motor 76 will approach and follow the speed of the close motor 96 and may slow down to a slightly greater extent than the close motor 96 but will always return to a speed close to or the same as that of the close motor, that is, a speed substantially the same as that of the close motor. The resistance of the rotors of the motors 76 and 96 may be selected such that the slope of the operating curve 220 is not steeper than the slope of the operating curve 224. However, preferably, slopes should be selected and the power supplies 150 and 180 adjusted such that the slopes intersect and the motors tend to operate during a raising operation at the intersecting point 228 of the operating curves of the two motors at which the load of the bracket and material which it carries is equally divided. Thus, unless the bucket has been manipulated for opening and closing purposes, during its raising operation the load of the bucket and the material 28 which it carries is automatically substantially equally shared between the hold hoist 70 and close hoist 90.

For a lowering operation, for example when the control stick 112 is moved to the lower sector 122, the frequency of the power supplied to the hold motor 76 and close motor 96 respectively by the adjustable frequency power supplies 150 and 180 will be 60 hertz and 68 hertz and cause the hold motor 76 and drum 82 and close motor 96 and drum 102 to rotate at speeds corresponding to such frequencies. However, due to the load of the bucket 4 and any material 28 which it may carry, the speeds of the hold motor 76 and close motor 96 immediately increase respectively along the operating curves 226 and 222 as shown in FIG. 8. In the operation of the close motor 96, as the load on it increases and it correspondingly increases its torque, it will rotate at a slip speed slightly faster than the speed corresponding to its supply frequency of 68 hertz. The hold motor 76 will also take up load and increase torque output to control the load of the bucket 4 and the material 28, but the speed of the motor 76 will increase considerably more than the speed of the close motor 96 and the speed corresponding to its input supply frequency of 60 hertz due to the steep slope of its operating curve 226 compared to the operating curve 222 of the close motor 96. Thus, the hold motor 76 will increase its speed a it follows its characteristic curve 226 to a portion 227 of the curve 226 past the intersection 230 of the curves 222 and 226. However, due to the higher speed in the lowering direction of the hold motor after the hold motor speed increases past the curve intersection 230 compared to the speed of the close motor as the latter follows it curve 222 to a portion 223 of the curve 222 past the intersection 230, the load on the hold motor 76 will decrease and the close motor 96 will consequently assume an increased portion of the load since the close motor is operating at a lower frequency area than the hold motor at a corresponding torque range value. In response to the increased load assumed by the close motor, the speed of the hold motor decreases to approach and follow the speed of the close motor so that the load assumed by the hold motor increases and the load assumed by the close motor decreases. Thus, the hold motor 76 operates at a speed close to and slightly faster than or at substantially the same speed as that of the close motor. Similar to the description with reference to the raising operation shown in FIG. 7, the resistance of the rotors of the motors 76 and 96 may be selected such that the slope of the operating curve 222 is not steeper than the slope of the operating curve 224. Preferably, however, slopes should be selected and the adjustable frequency power supplies 150 and 180 adjusted such that the motors 96 and 76 tend to operate during a lowering operation at the intersecting point 230 at which the load of the bucket and material is automatically divided substantially equally between the two motors.

It should be noted that when the control stick 112 is moved a distance from its vertical location less than its maximum distance to a non-vertical position into one of the sectors or to one of the locations of the switch control 106 so that lower frequencies less than the maximum available from the power supplies are supplied to the close and hold motors, the lower frequencies will have the same frequency relationship as shown by the close motor characteristic curve 220 and the hold motor characteristic curve 224 in FIGS. 7 and 8.

A hoist drive may thus be operated to either raise or lower a double hoist bucket with the use of relatively economical and maintenance free squirrel cage motors. Whether, squirrel cage or wound rotor a.c. induction motors are used, they may be supplied by variable frequency power supplies to provide precise speed control in the opening and closing of the bucket and in its raising and lowering. Providing of the hoist hold motor and hoist close motor with respectively high and low slope characteristic operating curves and providing the motors with adjustable frequency power supplies permits automatic equal load sharing between the two motors and further permits operating of the motors at higher speeds than previously permitted by the use of variable frequency power supplies operated at frequencies in excess of the normal 60 hertz rated motor frequency.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. In a double hoist bucket apparatus having a bucket for lifting and carrying material, a hold hoist comprising a hold hoist drum and a rotatable hold motor means for providing bucket raising and lowering rotation of the hold hoist drum, a close hoist comprising a close hoist drum and a rotatable close motor means for providing bucket raising and lowering rotation of the close hoist drum, the bucket being suspended from the hold hoist drum and having a frame and openable and closeable members attached to the frame, the combination comprising:

hold rope means connected between the hold hoist drum and the frame of the bucket for suspending the bucket from the hold hoist drum and for raising and lowering the bucket in response respectively to raising and lowering rotation of the hold motor means;

close rope means connected between the close hoist drum and the openable and closeable bucket members for raising and lowering the bucket in response respectively to raising and lowering rotation of the close motor means;

hold motor power supply means for supplying a.c. power at a preselected first hold motor frequency to the hold motor means during raising of the bucket;

close motor power supply means for supplying a.c. power at a preselected first close motor frequency to the close motor means during raising of the bucket;

the hold motor means has a frequency to torque first hold curve along which the hold motor means operates and which determines the speed of the hold motor means during raising of the bucket, the first hold curve having a first hold slope and a first hold frequency range determined by the preselected first hold motor frequency supplied to the hold motor means;

the close motor means has a frequency to torque first close curve along which the close motor means operates and which determines the speed of the close motor means during raising of the bucket, the first close curve having a first close slope not steeper than the first hold slope of the first hold curve and a first close frequency range determined by the preselected first close motor frequency supplied to the close motor means; and the first hold curve has a first hold portion located along the first hold frequency range and the first close curve has a first close portion located along the first close frequency range at frequencies higher than the first hold portion at corresponding torque values, the close motor means rotating at a higher speed than that of the hold motor means when the close motor means operates along said first close portion of the first close curve.

2. The combination according to claim 1 wherein the slopes of the first hold curve and first close curve are parallel.

3. The combination according to claim 1 wherein the slope of the first hold curve is steeper than the slope of the first close curve and the two curves intersect, the close motor means rotating along a speed range between a higher speed than that of the hold motor means and a speed equal to that of the hold motor means at the intersection of the first close and hold curves.

4. The combination according to claim 3 wherein:

the bucket and the material carried by the bucket comprise a load on the hold motor means and close motor means during a raising of the bucket; and the first hold and close curves intersect at a raising intersection point at which the load is shared substantially equally by the hold motor means and the close motor means.

5. The combination according to claim 3 wherein:

the bucket and the material carried by the bucket comprise a load on the hold motor means and close motor means during raising of the bucket; and the first hold and close curves intersect at a raising intersection point at which the load is shared by the hold motor means and the close motor means and each motor means produces torque at the raising intersection point which is not greater than 100% rated full load torque at 60 hertz for that motor means.

6. The combination according to claim 1 wherein at least one of the preselected first hold motor and first close motor frequencies is greater than 60 hertz.

7. The combination according to claim 1, 2, 3, 4, 5 or 6 wherein:

the hold motor power supply means supplies a.c. power at a preselected second hold motor frequency to the hold motor means during lowering of the bucket;

the close motor power supply means supplies a.c. power at a preselected second close motor frequency to the close motor means during lowering of the bucket;

the hold motor means has a frequency to torque second hold curve along which the hold motor means operates and which determines the speed of the hold motor means during lowering of the bucket, the second hold curve having a second hold slope and a second hold frequency range determined by the preselected second hold motor frequency supplied to the hold motor means;

the close motor means has a frequency to torque second close curve along which the close motor means operates and which determines the speed of the close motor means during lowering of the bucket, the second close curve having a second close slope not steeper than the second hold slope of the second hold curve and a second close frequency range determined by the preselected second close motor frequency supplied to the close motor means; and the second hold curve has a second hold portion located along the second hold frequency range and the second close curve has a second close portion located along the second close frequency range at frequencies lower than the second hold portion at corresponding torque values, the close motor means rotating at a lower speed than that of the hold motor means when the close motor means operates along said second close portion of the second close curve.

8. The combination according to claim 7 wherein the slopes of the second hold curve and second close curve are parallel.

9. The combination according to claim 7 wherein the slope of the second hold curve is steeper than the slope of the second close curve and the two curves intersect, the close motor means rotating along a speed range between a lower speed than that of the hold motor means and a speed equal to that of the hold motor means at the intersection of the second close and hold curves.

10. The combination according to claim 9 wherein:

the bucket and the material carried by the bucket comprise a load on the hold motor means and close motor means during lowering of the bucket; and the second hold and close curves intersect at a lowering intersection point at which the load is shared equally by the hold motor means and the close motor means.

11. The combination according to claim 9 wherein:

the bucket and the material carried by the bucket comprise a load on the hold motor means and close motor means during lowering of the bucket; and the second hold curve and the second close curve intersect at a lowering intersection point at which the load is shared by the hold motor means and the close motor means and each motor produces torque at the lowering intersection point which is not greater than 100% rated full load torque at 60 hertz for that motor.

12. The combination according to claim 7 wherein at least one of the preselected second hold motor and second close motor frequencies is greater than 60 hertz.

13. In a double hoist carrying apparatus having a hold hoist comprising a rotatable hold hoist drum and hold motor means for providing raising and lowering rotation of the hold hoist drum, a close hoist comprising a rotatable close hoist drum and close motor means for providing raising and lowering rotation of the close hoist drum, and a carrying member suspended from the hold hoist drum and having a frame and a plurality of openable and closeable members attached to the frame, the combination comprising:

hold rope means connected between the hold hoist drum and the frame of the carrying member for suspending the carrying member from the hold hoist drum and for raising and lowering the carrying member in response respectively to raising and lowering rotation of the hold motor means;

close rope means connected between the close hoist drum and the openable and closeable plurality of members for closing and opening the plurality of members in response respectively to the application of tension and slack to the close rope means by the close hoist drum;

hold motor power supply means for supplying a.c. power at a first hold frequency to the hold motor means;

close motor power supply means for supplying a.c. power at a first close frequency to the close motor means;

the hold motor means has a frequency to torque first hold curve having a first slope, the hold motor means rotating the hold hoist drum at a raising rotational speed determined by the first hold frequency and the first hold curve slope;

the close motor means has a frequency to torque first close curve having a first slope, the close motor means rotating the close hoist drum at a raising rotational speed determined by the first close frequency and the first close curve slope; and the first close frequency and first close curve slope being such that the first close curve lies along higher frequency values than the frequency values along which the first hold curve lies at corresponding torque values on the first close and first hold curves greater than a first predetermined torque value, and the close hoist drum thereby has a faster raising rotational speed than the raising rotational speed of the hold hoist drum at said greater torque values such that the close hoist drum applies tension to the close rope means to close the plurality of openable and closeable members.

14. The apparatus according to claim 13 wherein:

the hold motor power supply means supplies a.c. power at a second hold frequency to the hold motor means;

the close motor power supply means supplies a.c. power at a second close frequency to the close motor means;

the hold motor means has a frequency to torque second hold curve having a slope, the hold motor means rotating the hold hoist drum at a lowering rotational speed determined by the second hold frequency and the second hold curve slope;

the close motor means has a frequency to torque second close curve having a slope, the close motor means rotating the close hoist drum at a lowering rotational speed determined by the second close frequency and the second close curve slope; and the second close frequency and second close curve slope being such that the second close curve lies along lower frequency values than the frequency values along which the second hold curve lies at corresponding torque values on the second close and second hold curves greater than a second predetermined torque value, and the close hoist drum thereby has a slower lowering rotational speed than the lowering rotational speed of the hold hoist drum at said greater torque values such that the close hoist drum applies tension to the close rope means to close the plurality of openable and closeable members.

15. The apparatus according to claim 13 or 14 wherein the first hold curve slope is steeper than the first close curve slope and the two curves have a raising intersection point.

16. The apparatus according to claim 14 wherein at least one of the first or second hold motor and first or second close motor frequencies is greater than 60 hertz.

17. The apparatus according to claim 14 wherein:

the first hold curve slope is steeper than the first close curve slope and the first hold and close curves intersect; and the second hold curve slope is steeper than the second close curve slope and the second hold and close curves intersect.

18. The apparatus according to claim 17 wherein the first hold and close curves intersect at the first predetermined torque value and the second hold and close curves intersect at the second predetermined torque value.

19. The apparatus according to claim 18 further including material carried in the carrying member, the carrying member and material together comprising a load on the hoist, wherein:

the load is shared equally at the first predetermined torque value by the hold motor means and close motor means during a raising operation; and the load is shared equally at the second predetermined torque value by the hold motor means and close motor means during a lowering operation.

20. In a method of operating a carrying member for raising, carrying and dumping material, the carrying member and any material it may carry comprising a load, the load being suspended by close rope means from a close hoist drum rotated by a close motor and by hold rope means from a hold hoist drum rotated by a hold motor, the steps comprising:

operating the close motor along a first close speed to torque curve having speed values decreasing with increasing torque output to rotate the close hoist drum and raise the load;

operating the hold motor along a first hold speed to torque curve having speed values decreasing with increasing torque output a greater amount than the speed values of the close speed to torque curve to rotate the hold hoist drum and raise the load;

applying the load to the close motor and hold motor to cause the close motor to increase its torque output to assume a portion of the load and consequently decrease in speed as it operates along the first close speed to torque curve and to cause the hold motor to increase its torque output to assume a portion of the load and consequently decrease in speed a greater amount than the speed decrease of the close motor as the hold motor operates along the first hold speed to torque curve;

in response to the greater speed decrease of the hold motor than the speed decrease of the close motor so that the close motor speed is higher than the speed of the hold motor, increasing the portion of the load assumed by the close motor; and in response to the increase in the portion of the load assumed by the close motor, increasing the speed of the hold motor to approach the speed of the close motor so that the load assumed by the hold motor also increases and the load assumed by the close motor decreases, whereby the load is shared by the close motor and hold motor at their approaching raising operating speeds.

21. The method according to claim 20 wherein the method includes lowering the load, the further steps comprising:

operating the close motor along a second close speed to torque curve having speed values increasing with increasing torque output to rotate the close hoist drum and lower the load;

operating the hold motor along a second hold speed to torque curve having speed values increasing with increasing torque output a greater amount than the speed values of the close speed to torque curve to rotate the hold hoist drum and lower the load;

applying the load to the close motor and hold motor to cause the close motor to increase its torque output to assume a portion of the load and consequently increase in speed as it operates along the second close speed to torque curve and to cause the hold motor to increase its torque output to assume a portion of the load and consequently increase in speed a greater amount than the speed increase of the close motor as the hold motor operates along the second hold speed to torque curve;

in response to the greater speed increase of the hold motor than the speed increase of the close motor so that the close motor speed is lower than the speed of the hold motor, increasing the portion of the load assumed by the close motor; and in response to the increase in the portion of the load assumed by the close motor, decreasing the speed of the hold motor to approach the speed of the close motor so that the load assumed by the hold motor increases and the load assumed by the close motor decreases, whereby the load is shared by the close motor and hold motor at their approaching lowering operating speeds.

22. The method according to claim 21 comprising the further step of supplying to the close motor during lowering of the load a.c. power at a frequency greater than 60 hertz.

23. The method according to claim 21 wherein the step of operating the close motor to raise the load includes operating the close motor along a first close speed to torque curve intersecting the first hold speed to torque curve.

24. The method according to claim 23 comprising the further step of:

estimating the point of intersection of the first close speed to torque curve at which the load is typically share substantially equally by the close and hold motors; and operating the close motor along a first close speed to torque curve passing through the intersection point to lower the load.

25. The method according to claim 20 wherein the step of operating the close motor to raise the load includes operating the close motor along a first close speed to torque curve intersecting the first hold speed to torque curve.

26. The method according to claim 25 comprising the further step of:

estimating the point of intersection of the first close speed to torque curve at which the load is typically shared substantially equally by the close and hold motors; and operating the close motor along a first close speed to torque curve passing through the intersection point to lower the load.

* * * * *